US008459375B2

(12) United States Patent
Radford

(10) Patent No.: US 8,459,375 B2
(45) Date of Patent: Jun. 11, 2013

(54) TOOLS FOR USE IN DRILLING OR ENLARGING WELL BORES HAVING EXPANDABLE STRUCTURES AND METHODS OF MAKING AND USING SUCH TOOLS

(75) Inventor: Steven R. Radford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 333 days.

(21) Appl. No.: 12/895,166

(22) Filed: Sep. 30, 2010

(65) Prior Publication Data

US 2011/0073371 A1 Mar. 31, 2011

Related U.S. Application Data

(60) Provisional application No. 61/247,112, filed on Sep. 30, 2009.

(51) Int. Cl.
*E21B 7/28* (2006.01)
*E21B 10/32* (2006.01)

(52) U.S. Cl.
USPC ..... 175/57; 175/268; 175/269; 175/406

(58) Field of Classification Search
USPC ..... 175/57, 263, 267, 268, 269, 274, 175/291, 406
See application file for complete search history.

(56) References Cited

U.S. PATENT DOCUMENTS 1,921,135 A * 8/1933 Santiago ..... 175/269
3,105,562 A * 10/1963 Stone et al. ..... 175/268
3,126,065 A * 3/1964 Chadderdon ..... 175/269
4,565,252 A * 1/1986 Campbell et al. ..... 175/269
4,635,738 A 1/1987 Schillinger et al.
5,402,856 A 4/1995 Warren et al.
5,495,899 A 3/1996 Pastusek et al.
5,957,223 A 9/1999 Doster et al.
RE36,817 E 8/2000 Pastusek et al.
6,360,831 B1 3/2002 Akesson et al.
7,036,611 B2 5/2006 Radford et al.
7,308,937 B2 12/2007 Radford et al.

(Continued)

OTHER PUBLICATIONS

International Preliminary Report on Patentability for International Application No. PCT/US2010/050917 dated Apr. 3, 2012, 7 pages.

(Continued)

*Primary Examiner* — Jennifer H Gay
(74) *Attorney, Agent, or Firm* — TraskBritt

(57) ABSTRACT

Expandable reamers for enlarging boreholes in subterranean formations include a tubular body and at least one member positioned in openings in the tubular body. The at least one member is configured to move between retracted and extended positions. A push sleeve is disposed at least partially within the tubular body and coupled to the at least one member. The push sleeve moves axially upward to move the at least one member to the extended position in response to a pressure of drilling fluid passing through a drilling fluid flow path in the tubular body. The push sleeve moves axially downward to move the at least one member to the retracted position in response to a pressure of drilling fluid upon a restrictive element disposed within the fluid passageway. The restrictive element disposed within the fluid passageway may be discarded from the fluid passageway by increasing the flow rate through the drilling fluid flow path.

18 Claims, 6 Drawing Sheets

U.S. PATENT DOCUMENTS

| | | | | |
|---|---|---|---|---|
| 7,900,717 | B2 * | 3/2011 | Radford et al. | 175/269 |
| 8,028,767 | B2 * | 10/2011 | Radford et al. | 175/269 |
| 8,230,951 | B2 * | 7/2012 | Radford et al. | 175/267 |
| 2007/0095573 | A1 | 5/2007 | Telfer | |
| 2008/0017375 | A1 | 1/2008 | Wardley | |
| 2008/0128169 | A1 | 6/2008 | Radford et al. | |
| 2008/0128175 | A1 | 6/2008 | Radford et al. | |
| 2009/0032308 | A1 | 2/2009 | Eddison | |
| 2009/0114448 | A1 * | 5/2009 | Laird et al. | 175/61 |
| 2009/0145666 | A1 * | 6/2009 | Radford et al. | 175/269 |
| 2010/0089583 | A1 * | 4/2010 | Xu et al. | 166/298 |
| 2011/0073371 | A1 * | 3/2011 | Radford | 175/57 |
| 2011/0127044 | A1 * | 6/2011 | Radford et al. | 166/373 |
| 2011/0203849 | A1 * | 8/2011 | Radford et al. | 175/57 |

OTHER PUBLICATIONS

International Search Report for International Application No. PCT/US2010/050917 mailed Apr. 29, 2011, 4 pages.

International Written Opinion for International Application No. PCT/US2010/050917 mailed Apr. 29, 2011, 5 pages.

* cited by examiner

TOOLS FOR USE IN DRILLING OR ENLARGING WELL BORES HAVING EXPANDABLE STRUCTURES AND METHODS OF MAKING AND USING SUCH TOOLS

CROSS-REFERENCE TO RELATED APPLICATION

This application claims the benefit of U.S. Provisional Patent Application Ser. No. 61/247,112, filed Sep. 30, 2009, the disclosure of which is hereby incorporated herein in its entirety by this reference.

TECHNICAL FIELD

The present invention relates generally to an expandable apparatus for use in drilling or enlarging a subterranean borehole and, more particularly, to an expandable apparatus for enlarging a subterranean borehole beneath a casing or liner.

BACKGROUND

Expandable reamers are typically employed for enlarging subterranean boreholes. Conventionally, in drilling oil, gas, and geothermal wells, casing is installed and cemented to prevent the well bore walls from caving into the subterranean borehole while providing requisite shoring for subsequent drilling operation to achieve greater depths. Casing is also conventionally installed to isolate different formations, to prevent cross flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, which is assigned to the assignee of the present invention. A bi-center bit assembly employs two longitudinally superimposed bit sections with laterally offset axes, which, when rotated, produce an enlarged borehole diameter. An example of a bi-center bit is disclosed in U.S. Pat. No. 5,957,223, which is also assigned to the assignee of the present invention.

Another conventional approach used to enlarge a subterranean borehole includes employing an extended bottom-hole assembly with a pilot drill bit at the distal end thereof and a reamer assembly some distance above the pilot drill bit. This arrangement permits the use of any standard rotary drill bit type (e.g., a rock bit or a drag bit), as the pilot bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom hole assembly is particularly significant in directional drilling. The assignee of the present invention has, to this end, designed as reaming structures so called "reamer wings," which generally comprise a tubular body having a fishing neck with a threaded connection at the top thereof and a tong die surface at the bottom thereof, also with a threaded connection. U.S. Pat. No. RE36,817 and U.S. Pat. No. 5,495,899, both of which are assigned to the assignee of the present invention, disclose reaming structures including reamer wings. The upper midportion of the reamer wing tool includes one or more longitudinally extending blades projecting generally radially outwardly from the tubular body and PDC cutting elements are provided on the blades.

As mentioned above, conventional expandable reamers may be used to enlarge a subterranean borehole and may include blades that are pivotably or hingedly affixed to a tubular body and actuated by way of a piston disposed therein as disclosed by, for example, U.S. Pat. No. 5,402,856 to Warren. In addition, U.S. Pat. No. 6,360,831 to Åkesson et al., discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string, and, once the tool has passed beyond the end of the casing, the blades are extended so the bore diameter may be increased below the casing. In addition, United States Patent Application Publication No. U.S. 2008/0128175 A1, which application was filed Dec. 3, 2007 and entitled "Expandable Reamers for Earth-Boring Applications," discloses additional expandable reamer apparatus, the entire disclosure of which is incorporated herein by this reference.

BRIEF SUMMARY

In some embodiments, the present invention includes expandable apparatus for use in a subterranean borehole. The expandable apparatus include a tubular body having at least one opening in a wall of the tubular body and a drilling fluid flow path extending therethrough. At least one member may be positioned within the at least one opening in the wall of the tubular body wherein the at least one member is configured to move between a retracted position and an extended position. The expandable apparatus also includes a push sleeve at least partially disposed in the tubular body and coupled to the at least one member. The push sleeve is configured to move axially upward responsive to a pressure of drilling fluid passing through the drilling fluid flow path to extend the at least one member into the extended position. The push sleeve is also configured to move axially downward in response to a pressure of drilling fluid upon a restrictive element disposed within the fluid passageway to retract the at least one member into the retracted position.

In additional embodiments, the present invention includes methods of forming an expandable apparatus for use in drilling or enlarging a borehole in a subterranean formation. The method includes forming a tubular body having at least one opening in a wall of the tubular body and having a drilling fluid flow path extending therethrough. At least one member is positioned within the opening in the wall of the tubular body and configured to move between an extended position and a retracted position. A push sleeve is disposed at least partially within the tubular body coupled to the at least one member. The push sleeve is configured to move axially upward responsive to a pressure of drilling fluid passing through the drilling fluid flow path to extend the at least one member into the extended position and to move axially downward in response to a pressure of drilling fluid upon a restrictive element disposed within the fluid passageway to retract the at least one member into the retracted position.

In yet additional embodiments, the present invention includes methods of moving at least one extendable member of an earth-boring tool. The method includes flowing a drilling fluid through a drilling fluid passageway extending through a push sleeve disposed within a tubular body of the earth-boring tool. The push sleeve moves axially upward in response to a pressure of the fluid upon the push sleeve and extends the at least one extendable member coupled to the push sleeve. The method further includes disposing a restrictive element within the drilling fluid passageway and the push sleeve moves axially downward in response to a pressure of the fluid upon the restrictive element and retracts the at least one extendable member.

BRIEF DESCRIPTION OF THE DRAWINGS

While the specification concludes with claims particularly pointing out and distinctly claiming what are regarded as embodiments of the invention, various features and advantages of embodiments of the invention may be more readily ascertained from the following description of some embodiments of the invention, when read in conjunction with the accompanying drawings, in which:

DETAILED DESCRIPTION OF THE INVENTION

The illustrations presented herein are, in some instances, not actual views of any particular reamer tool, cutting element, or other feature of a reamer tool, but are merely idealized representations that are employed to describe embodiments of the present invention. Additionally, elements common between figures may retain the same numerical designation.

Figure 1:
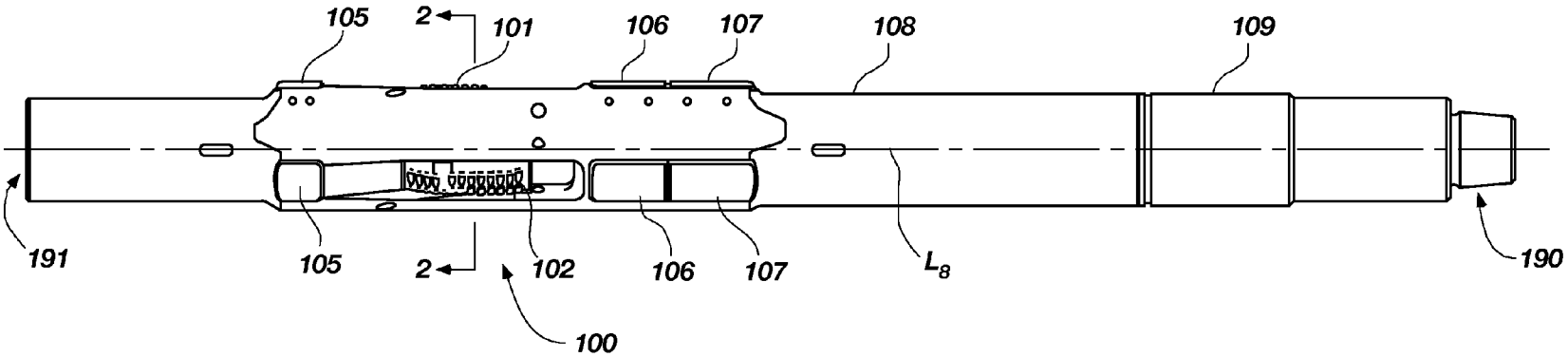
FIG. 1 is a side view of an embodiment of an expandable reamer apparatus of the invention.

Various embodiments of the disclosure are directed to an expandable apparatus. By way of example and not limitation, an expandable apparatus may comprise an expandable reamer apparatus, an expandable stabilizer apparatus or similar apparatus. FIG. 1 illustrates an expandable apparatus 100 according to an embodiment of the disclosure comprising an expandable reamer. The expandable apparatus 100 may be similar to the expandable apparatus described in U.S. Patent Publication No. 2008/0128175, the entire disclosure of which is incorporated herein by this reference.

The expandable apparatus 100 in the form of an expandable reamer may include a generally cylindrical tubular body 108 having a longitudinal axis $L_8$. The tubular body 108 of the expandable apparatus 100 may have a lower end 190 and an upper end 191. The terms "lower" and "upper," as used herein with reference to the ends 190, 191, refer to the typical positions of the ends 190, 191 relative to one another when the expandable apparatus 100 is positioned within a well bore. The lower end 190 of the tubular body 108 of the expandable apparatus 100 may include a set of threads (e.g., a threaded male pin member) for connecting the lower end 190 to another section of a drill string or another component of a bottom-hole assembly (BHA), such as, for example, a drill collar or collars carrying a pilot drill bit for drilling a well bore. Similarly, the upper end 191 of the tubular body 108 of the expandable apparatus 100 may include a set of threads (e.g., a threaded female box member) for connecting the upper end 191 to another section of a drill string or another component of a bottom-hole assembly (BHA).

Three sliding members such as, for example, cutter blocks or blades 101, 102, 103 (see FIG. 2) are positionally retained in circumferentially spaced relationship in the tubular body 108, as further described below, and may be provided at a position along the expandable apparatus 100 intermediate the first lower end 190 and the second upper end 191. The blades 101, 102, 103 may be comprised of steel, tungsten carbide, a particle-matrix composite material (e.g., hard particles dispersed throughout a metal matrix material), or other suitable materials as known in the art. The blades 101, 102, 103 are retained in an initial, retracted position within the tubular body 108 of the expandable apparatus 100 as illustrated in FIG. 3, but may be moved responsive to application of hydraulic pressure into the extended position (shown in FIGS. 4 and 6) and moved into a retracted position (shown in FIG. 5) when desired, as will be described herein. The expandable apparatus 100 may be configured such that the blades 101, 102, 103 engage the walls of a subterranean formation surrounding a well bore in which apparatus 100 is disposed to remove formation material when the blades 101, 102, 103 are in the extended position, but are not operable to so engage the walls of a subterranean formation within a well bore when the blades 101, 102, 103 are in the retracted position. While the expandable apparatus 100 includes three blades 101, 102, 103, it is contemplated that one, two or more than three blades may be utilized to advantage. Moreover, while the blades 101, 102, 103 are symmetrically circumferentially positioned about the longitudinal axis $L_8$ along the tubular body 108, the blades may also be positioned circumferentially asymmetrically as well as asymmetrically about the longitudinal axis $L_8$.

The expandable apparatus 100 may, optionally, include a plurality of stabilizer blocks 105, 106, 107. In some embodiments, the mid stabilizer block 106 and the lower stabilizer block 107 may be combined into a unitary stabilizer block. The stabilizer blocks 105, 106, 107 help to center the expandable apparatus 100 in the drill hole while being run into position through a casing or liner string and also while drilling and reaming the borehole. In other embodiments, no stabilizer blocks may be employed. In such embodiments, the tubular body may comprise a larger outer diameter in the longitudinal portion where the stabilizing blocks are shown in FIG. 1 to provide a similar centering function as provided by the stabilizing blocks.

The upper stabilizer block 105 may be used to stop or limit the forward motion of the blades 101, 102, 103 (see also FIG. 3), determining the extent to which the blades 101, 102, 103 may engage a bore hole while drilling. The upper stabilizer block 105, in addition to providing a back stop for limiting the lateral extent of the blades, may provide for additional stability when the blades 101, 102, 103 are retracted and the expandable apparatus 100 of a drill string is positioned within a bore hole in an area where an expanded hole is not desired while the drill string is rotating. Advantageously, the upper stabilizer block 105 may be mounted, removed and/or replaced by a technician, particularly in the field, allowing the extent to which the blades 101, 102, 103 engage the bore hole to be readily increased or decreased to a different extent than illustrated. Optionally, it is recognized that a stop associated on a track side of the upper stabilizer block 105 may be customized in order to arrest the extent to which the blades 101, 102, 103 may laterally extend when fully positioned to the extended position along blade tracks 148. The stabilizer blocks 105, 106, 107 may include hard faced bearing pads (not shown) to provide a surface for contacting a wall of a bore hole while stabilizing the apparatus therein during a drilling operation.

Figure 2:
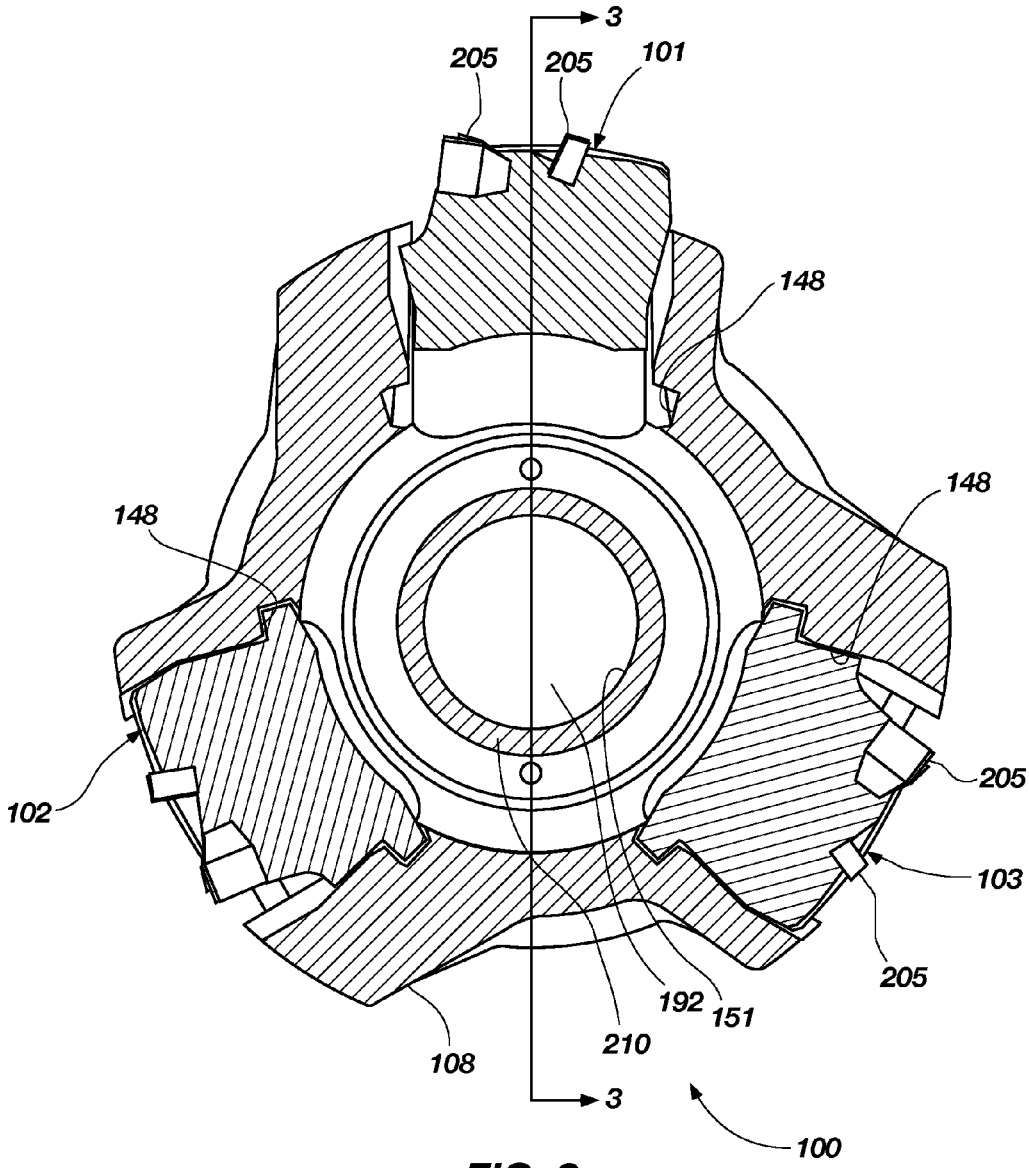
FIG. 2 shows a transverse cross-sectional view of the expandable reamer apparatus as indicated by section line 2-2 in FIG. 1.
Figure 3:
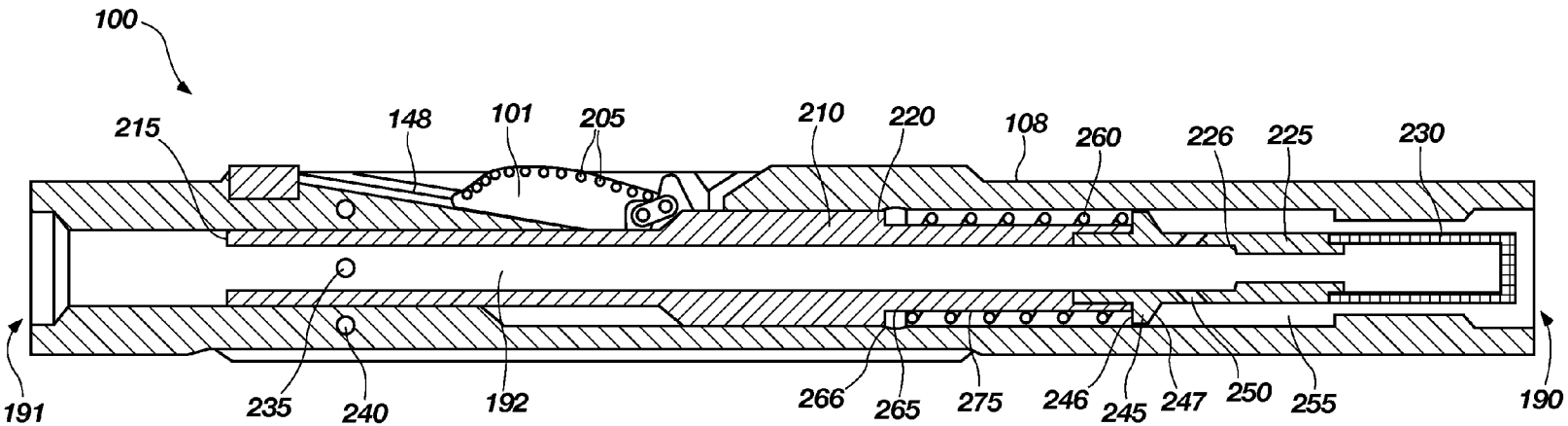
FIG. 3 shows a longitudinal cross-sectional view of one embodiment of the expandable reamer apparatus shown in FIG. 1 in the initial tool position prior to actuation of the blades.

FIG. 2 is a cross-sectional view of the expandable apparatus 100 shown in FIG. 1 taken along section line 2-2 shown therein. As shown in FIG. 2, the tubular body 108 encloses a fluid passageway 192 that extends longitudinally through the tubular body 108. The fluid passageway 192 directs fluid substantially through an inner bore 151 of a push sleeve 210.

Referring to FIG. 2, to better describe aspects of the invention, blades 102 and 103 are shown in the initial or retracted positions, while blade 101 is shown in the outward or extended position. The expandable apparatus 100 may be configured such that the outermost radial or lateral extent of each of the blades 101, 102, 103 is recessed within the tubular body 108 when in the initial or retracted positions so it may not extend beyond the greatest extent of outer diameter of the tubular body 108. Such an arrangement may protect the blades 101, 102, 103 as the expandable apparatus 100 is disposed within a casing of a borehole, and may allow the expandable apparatus 100 to pass through such casing within a borehole. In other embodiments, the outermost radial extent of the blades 101, 102, 103 may coincide with or slightly extend beyond the outer diameter of the tubular body 108. As illustrated by blade 101, the blades may extend beyond the outer diameter of the tubular body 108 when in the extended position, to engage the walls of a borehole in a reaming operation.

FIG. 3 is another cross-sectional view of the expandable apparatus 100 shown in FIGS. 1 and 2 taken along section line 3-3 shown in FIG. 2. Referring to FIGS. 2 and 3, the tubular body 108 positionally retrains three sliding cutter blocks or blades 101, 102, 103 in three respective blade tracks 148. The blades 101, 102, 103, each carry a plurality of cutting elements 205 for engaging the material of a subterranean formation defining the wall of an open borehole when the blades 101, 102, 103 are in an extended position (shown in FIG. 4). The cutting elements 205 may be polycrystalline diamond compact (PDC) cutters or other cutting elements known to a person of ordinary skill in the art and as generally described in U.S. Pat. No. 7,036,611, which is incorporated herein in its entirety by this reference.

Referring to FIG. 3, the blades 101, 102, 103 are hingedly coupled to a push sleeve 210. The push sleeve 210 is disposed within the tubular body 108 and configured to slide axially within the tubular body 108 in response to pressures applied at least one end surface of the push sleeve 210. In some embodiments, the push sleeve 210 may be disposed in the tubular body 108 and may be configured similar to the push sleeve described by U.S. Patent Publication No. 2008/0128175 referenced above and biased by a spring as described therein.

The push sleeve 210 may comprise an upper portion 215 and a lower portion 220 at opposing longitudinal ends. The push sleeve 210 may be configured and positioned so that the upper portion 215 of the push sleeve 210 comprises a smaller annular surface area than the lower portion 220 of the push sleeve 210 to create a greater force on the lower portion 220 of the push sleeve 210 than on the upper portion 215 of the push sleeve 210 when a pressure is exerted on both portions by a pressurized fluid as described in more detail below. The lower portion 220 of the push sleeve 210 may be coupled to a ball trap sleeve 225 and the ball trap sleeve 225 may be coupled to a screen catch 230. The ball trap sleeve 225 may comprise at least one protrusion 245 extending annularly from the push sleeve 210 to an inside wall of the tubular body 108. The at least one protrusion 245 of the push sleeve 210 may include an upper surface 246 and a lower surface 247. The screen catch 230 is configured to hold at least one expelled ball 300 (FIG. 6) as described in further detail below, without impeding the fluid flow through the screen catch 230 and may comprise any kind of screened enclosure, as known in the art. The screen catch 230 may also include a removable cap (not shown) for removal of the at least one expelled ball 300 (FIG. 6) when the expandable apparatus 100 is not in use.

Figure 5:
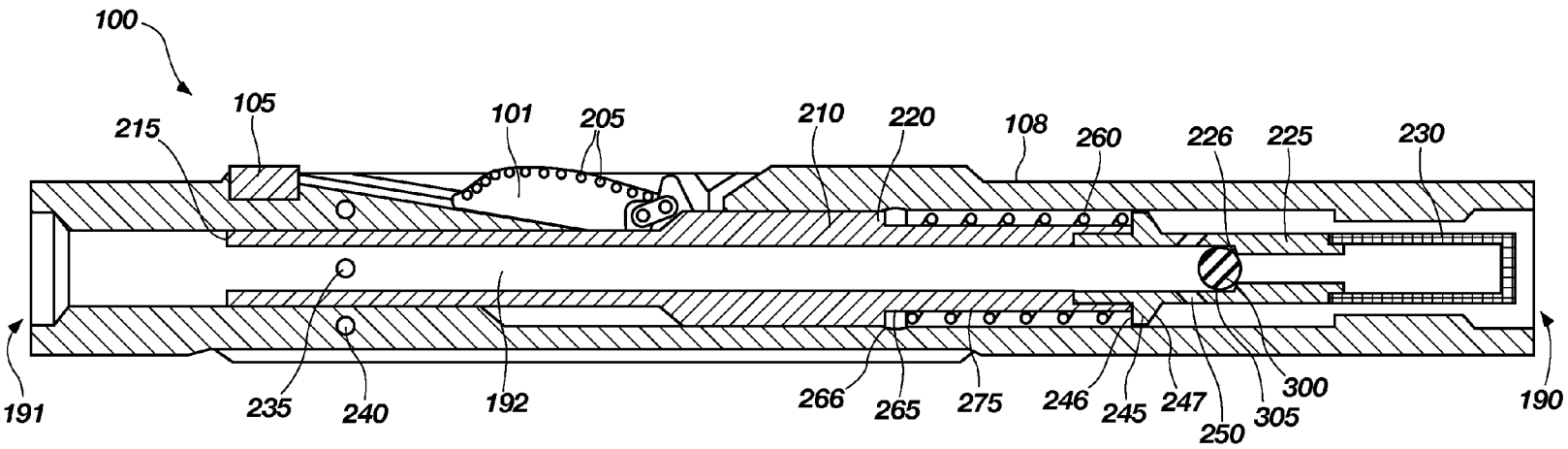
FIG. 5 shows an enlarged cross-sectional view of the expandable reamer apparatus shown in FIG. 3 in which the blades (one depicted) are held in the fully retracted position by the push sleeve under the influence of fluid pressure caused by the addition of a restrictive element to the expandable reamer apparatus.

The push sleeve 210 may include at least one fluid port 235 that may selectively communicate with a plurality of nozzle ports 240 extending through the tubular body 108 for directing a drilling fluid toward the blades 101, 102, 103 when the blades 101, 102, 103 are extended. The ball trap sleeve 225 may comprise at least one fluid port 250 in fluid communication with an annular chamber 255 located between an inner sidewall of the tubular body 108 and an outer surface of the ball trap sleeve 225 and also in communication with the lower surface 247 of the protrusion 245 of the ball trap sleeve 225. The ball trap sleeve 225 also may include a ball seat 226 for receiving a ball 300 (FIG. 5). The ball seat 226 may comprise, for example, a protrusion extending into the fluid passageway 192 configured to retain the ball 300. A compression spring 260 that resists the motion of the push sleeve 210 toward the upper end 191 of the expandable apparatus 100 may be retained on an outer surface 275 of the push sleeve 210 between a ring 265 attached in a groove 266 of the tubular body 108 and the upper surface 246 of the protrusion 245 of the ball trap sleeve 225.

In operation, the push sleeve 210 may be originally positioned toward the lower end 190 of the expandable apparatus 100, as shown in FIG. 3, so that the expandable apparatus 100 may be lowered into a well bore without the blades 101, 102, 103 engaging the walls of a subterranean formation surrounding the well bore. The compression spring 260 may resist the motion of the push sleeve 210 toward the upper end 191 of the expandable reamer apparatus, thus maintaining the blades 101, 102, 103 in the retracted position.

Figure 4:
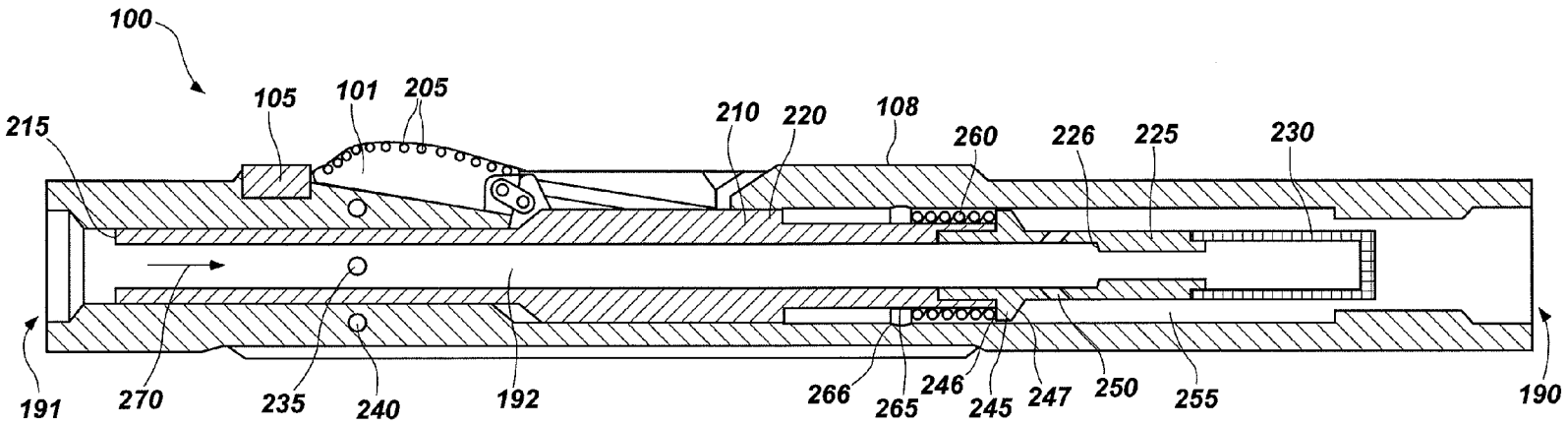
FIG. 4 shows a longitudinal cross-sectional view of the expandable reamer apparatus shown in FIG. 3 in which the blades (one depicted) are held in the fully extended position by the push sleeve under the influence of fluid pressure.

As shown in FIG. 4, once the expandable apparatus 100 is positioned in the well bore, a fluid, such as a drilling fluid, may be flowed through the fluid passageway 192 in the direction of arrow 270. Some of the fluid flowing through the fluid passageway 192 may travel through the fluid port 250 in the ball trap sleeve 225 into the annular chamber 255, causing the fluid to pressurize the annular chamber 255, exerting a force on the lower portion 220 of the push sleeve 210. Concurrently, some of the fluid flowing through the fluid passageway 192 exerts a force on the upper portion 215 of the push sleeve 210. As described above, the lower portion 220 of the push sleeve 210 has a larger surface area than the upper portion 215 of the push sleeve 210. Therefore, with equal or substantially equal pressures applied to the upper portion 215 of the push sleeve 210 and the lower portion 220 of the push sleeve 210 by the fluid, the force applied on the lower portion 220 of the push sleeve 210 will be greater than the force applied on the upper portion 215 of the push sleeve 210 by virtue of the fact that force is equal to the area of the surface multiplied by the pressure applied to that area. The resultant net force is toward the upper end 191 of the expandable apparatus 100. When the resultant net force is great enough to contract compression spring 260, the push sleeve 210 slides upward, extending the blades 101, 102, 103. In some embodiments, the pressurized fluid may also exert a force on the lower surface 247 of the protrusion 245 of the ball trap sleeve 225, which provides an additional force toward the upper end 191 of the expandable apparatus 100 thus extending the blades 101, 102, 103.

As shown in FIG. 5, when it is desired to retract the blades 101, 102, 103, drilling fluid flow may be momentarily ceased, if required, and a ball 300 may be dropped into the drill string and pumping of drilling fluid resumed. While the ball 300 is described herein, it is understood that any restrictive element may be used instead of the ball 300 or more than one ball 300 may be used. In some embodiments, the ball 300 may comprise a malleable and/or compressible material such as, for example, nylon, brass, lead rubber, hydrogenated nitrile butadiene rubber (HNBR), nitrile butadiene rubber (NBR), and other polymers and malleable materials known in the art. The ball 300 moves down the expandable apparatus 100 via gravity and/or fluid flow toward the lower end 190 of the expandable apparatus 100 where the ball 300 may become lodged in the ball seat 226 of the ball trap sleeve 225. When the ball 300 is lodged in the ball seat 226, the drilling fluid exerts a force on a surface 305 of the ball 300 in the direction of the lower end 190 of the expandable apparatus 100. The combined surface area of the surface 305 of the ball 300 and the upper portion 215 of the push sleeve 210 is greater than the surface area of the lower portion 220 of the push sleeve 210 Therefore, with equal or substantially equal pressures applied to the surface 305 of the ball 300, the upper portion 215 of the push sleeve 210, and the lower portion 220 of the push sleeve 210, by the fluid, the force applied on the surface 305 of the ball 300 and the upper portion 215 of the push sleeve 210 will be greater than the pressure applied on the lower portion 220 of the push sleeve 210. The resultant net force is in the direction of the lower end 190 of the expandable apparatus 100, which when combined with the force of the compression spring 260 expanding, causes the push sleeve 210 to slide downward and retract the blades 101, 102, 103.

Figure 6:
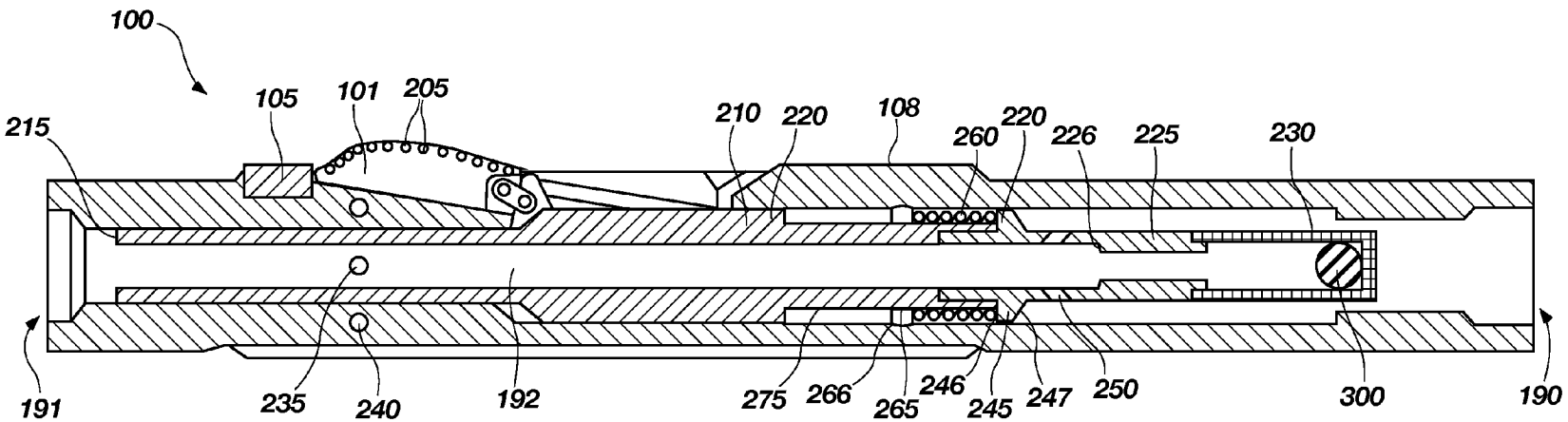
FIG. 6 shows an enlarged cross-sectional view of the expandable reamer apparatus shown in FIG. 3 in which the blades (one depicted) are held in the fully expanded position by the push sleeve under the influence of fluid pressure after the restrictive element has been expelled from the expandable reamer apparatus.

As shown in FIG. 6, when it is desired to trigger the expandable apparatus 100 to re-extend the blades 101, 102, 103, the drilling fluid flow is temporarily increased to, for example, at least double the pressure, until the ball 300 passes through the ball trap sleeve 225 into a screen catch 230. In another embodiment, a second ball (not shown) may be dropped into the drill string to block the at least one fluid port 250 thereby increasing the pressure in the fluid passageway 192. Because the ball 300 is formed of a malleable and/or compressible material, when the drilling fluid flow is increased, the pressure on the ball 300 may cause the ball 300 to deform or compress to a smaller size thus allowing the ball 300 to pass through the ball trap sleeve 225 into the screen catch 230. With the ball 300 in the screen catch 230, the fluid may travel unimpeded around the ball 300 out the screen catch 230. Once the ball 300 is in the screen catch 230, the drilling fluid flow may be reduced to the previous pressure. The resultant net force on the upper portion 215 of the push sleeve 210 and the lower portion 220 of the push sleeve 210 is in the direction of the upper end 191 of the expandable apparatus 100 and causes the push sleeve 210 to slide upward and extend the blades 101, 102, 103 as previously described in FIG. 4. The process of retracting and extending the blades 101, 102, 103 described in FIGS. 4 through 6 may be repeated as desired until the screen catch 230 cannot hold any additional balls 300 expelled from the ball trap sleeve 225.

Although the forgoing disclosure illustrates embodiments of an expandable apparatus comprising an expandable reamer apparatus, the disclosure should not be so limited. For example, in accordance with other embodiments of the disclosure, the expandable apparatus may comprise an expandable stabilizer, wherein the one or more expandable features may comprise stabilizer blocks (e.g., the cutter blocks 105, 106, 107 may be replaced with one or more stabilizer blocks). Thus, while certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art.

While particular embodiments of the invention have been shown and described, numerous variations and other embodiments will occur to those skilled in the art. Accordingly, it is intended that the invention only be limited in terms of the appended claims and their legal equivalents.

What is claimed is:

1. An expandable apparatus for use in drilling or enlarging a borehole in a subterranean formation, comprising:

a tubular body having at least one opening in a wall of the tubular body and having a drilling fluid flow path extending therethrough;

at least one member positioned within the opening in the wall of the tubular body, the at least one member configured to move between a retracted position and an extended position;

a push sleeve assembly disposed at least partially within the tubular body and coupled to the at least one member, the push sleeve assembly comprising:

a push sleeve configured to move axially upward responsive to a pressure of drilling fluid passing through the drilling fluid flow path and acting on a radially extending exterior surface of the push sleeve within an annular chamber in communication with the drilling fluid flow path and located between the push sleeve assembly and the tubular body to extend the at least one member into the extended position, the push sleeve also being configured to move axially downward in response to a pressure of drilling fluid within the drilling fluid flow path acting upon a restrictive element disposed within the drilling fluid flow path to retract the at least one member into the retracted position;

at least one interior protrusion axially below the at least one member sized and configured to retain the restrictive element within a fluid passageway at a first fluid pressure and to release the restrictive element at a second fluid pressure greater than the first fluid pressure; and at least one fluid port axially above the at least one protrusion and axially below the radially extending exterior surface and communicating between the fluid passageway and the annular chamber.

2. The expandable apparatus of claim 1, wherein the expandable apparatus comprises at least one of an expandable reamer apparatus and an expandable stabilizer apparatus.

3. The expandable apparatus of claim 2, wherein the expandable apparatus comprises the expandable reamer apparatus and the at least one member comprising at least one blade having at least one cutting element disposed thereon.

4. The expandable apparatus of claim 1, wherein the push sleeve is biased axially downward by a spring.

5. The expandable reamer apparatus of claim 1, wherein the push sleeve assembly further comprises an additional sleeve coupled to the push sleeve, the additional sleeve comprising the at least one protrusion and the at least one fluid port.

6. The expandable apparatus of claim 1, wherein the restrictive element comprises a ball comprising at least one of a compressible material and a deformable material.

7. The expandable reamer apparatus of claim 6, wherein the at least one member is configured to move from the retracted position to the extended position responsive to pressure of drilling fluid passing through the fluid passageway and the ball being expelled from the fluid passageway.

8. The expandable reamer apparatus of claim 6, further comprising at least one enclosure axially below the at least one protrusion, sized and configured to hold the ball expelled from the fluid passageway.

9. The expandable reamer apparatus of claim 8, wherein the at least one enclosure is sized and configured to hold more than one ball.

10. The expandable reamer apparatus of claim 6, wherein the push sleeve assembly further comprises an additional sleeve coupled to the push sleeve, the additional sleeve comprising the at least one protrusion, the at least one protrusion restricting a diameter of an aperture therethrough to a diameter less than a diameter of the ball when the ball is not at least one of compressed and deformed.

11. The expandable reamer apparatus of claim 9, wherein the at least one protrusion restricts a diameter of an aperture to a diameter greater than a diameter of the ball when the ball is at least one of compressed and deformed.

12. A method of moving at least one extendable member of an earth-boring tool, comprising:

flowing a drilling fluid through a drilling fluid passageway extending through a push sleeve assembly disposed within a tubular body of the earth-boring tool to cause the push sleeve assembly to move axially upward in response to a pressure of the drilling fluid upon a radially extending exterior surface of the push sleeve assembly within an annular chamber located between the push sleeve assembly and the tubular body and extend at least one extendable member coupled to the push sleeve assembly; and disposing and retaining a restrictive element within the drilling fluid passageway to cause the push sleeve assembly to move axially downward in response to a pressure of the drilling fluid upon the restrictive element and retract the at least one extendable member while maintaining drilling fluid flow through the tubular body.

13. The method of claim 12, further comprising increasing the flowing of drilling fluid from a first drilling fluid flow rate to a second greater drilling fluid flow rate to move the restrictive element out of the drilling fluid passageway and reduce pressure within the drilling fluid passageway.

14. The method of claim 13, further comprising decreasing the flowing of drilling fluid to the first drilling fluid flow rate after the restrictive element is moved out of the drilling fluid passageway to cause the push sleeve assembly to move axially upward in response to the pressure of the drilling fluid upon the radially extending exterior surface push sleeve assembly and extend the at least one member coupled to the push sleeve assembly.

15. The method of claim 13, further comprising catching the restrictive element in an enclosures having perforations through a wall thereof disposed within the tubular body of the earth-boring tool.

16. The method of claim 12, wherein disposing a restrictive element within the drilling fluid passageway to cause the push sleeve assembly to move axially downward in response to a pressure of the drilling fluid upon the restrictive element and retract the at least one extendable member comprises disposing a ball comprising at least one of a compressible material and a deformable material within the drilling fluid passageway, the ball being unable to pass through a restriction in the drilling fluid passageway when the compressible ball is not in at least one of a compressed state and a deformed state.

17. The method of claim 16, further comprising increasing the flowing of drilling fluid from a first drilling fluid flow rate to a second greater drilling fluid flow rate to increase a pressure on the ball to at least one of compress and deform the ball.

18. The method of claim 17, wherein increasing the flowing of drilling fluid from a first drilling fluid flow rate to a second greater drilling fluid flow rate to increase a pressure on the ball to compress the ball comprises at least one of compressing and deforming the ball to a size small enough to fit through the restriction.

* * * * *

UNITED STATES PATENT AND TRADEMARK OFFICE

CERTIFICATE OF CORRECTION

PATENT NO. : 8,459,375 B2
APPLICATION NO. : 12/895166
DATED : June 11, 2013
INVENTOR(S) : Steven R. Radford It is certified that error appears in the above-identified patent and that said Letters Patent is hereby corrected as shown below:

In the claims:

CLAIM 15, COLUMN 10, LINE 29, change "an enclosures" to --an enclosure--

Signed and Sealed this
Eighth Day of September, 2015

Michelle K. Lee

Michelle K. Lee
*Director of the United States Patent and Trademark Office*